US010858854B2

(12) United States Patent
Saxey

(10) Patent No.: US 10,858,854 B2
(45) Date of Patent: Dec. 8, 2020

(54) STRUCTURAL BRACE CORE HAVING A CUTOUT PATTERN

(71) Applicant: CoreBrace, LLC, West Jordan, UT (US)

(72) Inventor: Brandt Saxey, Alpine, UT (US)

(73) Assignee: CoreBrace, LLC, West Jordan, UT (US)

( * ) Notice: Subject to any disclaimer, the term of this patent is extended or adjusted under 35 U.S.C. 154(b) by 0 days.

(21) Appl. No.: 16/392,956

(22) Filed: Apr. 24, 2019

(65) Prior Publication Data

US 2020/0340264 A1 Oct. 29, 2020

(51) Int. Cl.

| | |
|---|---|
| ***E04H 9/02*** | (2006.01) |
| ***E04B 1/36*** | (2006.01) |
| ***E04B 1/30*** | (2006.01) |

(52) U.S. Cl.

CPC ..... *E04H 9/021* (2013.01); *E04B 1/30* (2013.01); *E04B 1/36* (2013.01)

(58) Field of Classification Search

CPC ..... E04B 1/98; E04B 1/30; E04B 1/36; E04B 1/985; E04B 2001/2415; E04C 3/30; E04C 3/293; E04G 25/04; E04G 23/02; E04H 9/021

USPC ..... 52/167.3

See application file for complete search history.

(56) References Cited

U.S. PATENT DOCUMENTS

| | | | | |
|---|---|---|---|---|
| 4,450,659 | A * | 5/1984 | Hanaoka | E04B 1/98 52/167.1 |
| 7,461,481 | B2 * | 12/2008 | Tsai | E04B 1/2403 52/167.3 |
| 8,424,252 | B2 * | 4/2013 | Tsai | E04H 9/02 52/167.1 |
| 8,590,258 | B2 * | 11/2013 | Hinchman | E04H 9/02 52/167.1 |
| 9,322,171 | B2 * | 4/2016 | Tsai | E04C 3/07 |
| 2001/0000840 | A1 * | 5/2001 | Takeuchi | E04H 9/02 52/167.1 |
| 2003/0222188 | A1 * | 12/2003 | Smelser | E04C 3/02 248/188.91 |
| 2005/0005539 | A1 * | 1/2005 | Nakamura | F16F 7/00 52/167.3 |
| 2008/0250732 | A1 * | 10/2008 | Tsai | E04H 9/02 52/167.3 |
| 2015/0218838 | A1 * | 8/2015 | Ichikawa | E04H 9/00 52/167.3 |
| 2015/0225951 | A1 * | 8/2015 | Tsai | E04C 3/02 52/836 |
| 2015/0225972 | A1 * | 8/2015 | Tsai | E04H 9/02 52/848 |
| 2017/0016504 | A1 * | 1/2017 | Braun | F16F 7/128 |

(Continued)

*Primary Examiner* — Beth A Stephan

(74) *Attorney, Agent, or Firm* — Kirton McConkie; Brian Tucker

(57) ABSTRACT

A structural brace may include a core member, which may include a first end, a second end, and a center portion. The center portion may include a cutout pattern disposed along a length of the center portion. In response to absorption of energy from seismic forces, the core member may provide plastic deformation and may be resistant to buckling. The structural brace may include a housing, which may surround at least the center portion of the core member. The structural brace may include a spacing material between the core member and the housing.

24 Claims, 7 Drawing Sheets

(56) References Cited

U.S. PATENT DOCUMENTS

2017/0234012 A1* 8/2017 Kimura ..... E04H 9/024
52/835

* cited by examiner

STRUCTURAL BRACE CORE HAVING A CUTOUT PATTERN

BACKGROUND

Earthquakes provide a unique challenge to building construction due to the magnitude of seismic forces that can be exerted on a building. A variety of building techniques have been utilized to minimize the impact of seismic forces exerted on buildings during an earthquake. For decades, steel frame structures have been a mainstay in construction of everything from low-rise apartment buildings to enormous skyscrapers dominating modern city skylines. Strength and versatility of steel is one reason for a lasting popularity of steel as a building material. However, oftentimes current building techniques may not withstand repeated and numerous seismic forces of large magnitude.

The subject matter claimed herein is not limited to embodiments that solve any disadvantages or that operate only in environments such as those described above. Rather, this background is only provided to illustrate one example technology area where some implementations described herein may be practiced.

SUMMARY OF THE INVENTION

The present disclosure relates generally to structural braces and related methods for manufacturing structural braces. In some embodiments, the structural braces may be configured to absorb seismic magnitude forces by undergoing deformation, thereby maintaining structural integrity of a building to which the structural brace is attached. More particularly, the present disclosure relates to a core member of a structural brace.

In some embodiments, a structural brace may include a core member, which may include a first end, a second end, and a center portion. In some embodiments, the center portion may include a cutout pattern disposed along a length of the center portion. In some embodiments, the core member may provide plastic deformation and resist buckling in response to absorption of energy. In some embodiments, the core member may be monolithically formed as a single unit and may have a constant width. In some embodiments, the cutout pattern may include a hole extending through the center portion. In some embodiments, the hole may include a generally oval shape.

In some embodiments, the cutout pattern may include a first paddle and/or a second paddle. In some embodiments, the first paddle and/or the second paddle may be within the oval shape and may extend from an edge of the hole. In some embodiments, the first paddle and/or the second paddle may be coupled to the center portion at a longitudinal vertex of the generally oval shape. In some embodiments, the first paddle and the second paddle may be spaced apart by a void between the first paddle and the second paddle. In some embodiments, the void may be configured to permit the first paddle and the second paddle to move toward each other as the core member is longitudinally compressed.

In some embodiments, the center portion may include one or more cutout patterns spaced apart along a length of the center portion. In some embodiments, the hole may include one or more of the following: a first elongated edge extending parallel to a longitudinal axis of the core member, a second elongated edge extending parallel to the longitudinal axis of the core member and parallel to the first elongated edge, a first angled edge extending from a first end of the first elongated edge, and a second angled edge extending from a second end of the first elongated edge.

In some embodiments, a length of the first angled edge may be equal to a length of the second angled edge. In some embodiments, the hole may include a third angled edge extending from a first end of the second elongated edge and/or a fourth angled edge extending from a second end of the second elongated edge. In some embodiments, the first paddle and/or the second paddle may be disposed between the first elongated edge and the second elongated edge.

In some embodiments, an end of the first paddle and an end of the second paddle may be spaced apart by the void, which may be disposed between the end of the first paddle and the end of the second paddle. In some embodiments, the end of the first paddle and/or the end of the second paddle may be perpendicular to the first elongated edge and the second elongated edge. In some embodiments, the first angled edge and/or the second angled edge may be angled between 30° and 60° with respect to the first elongated edge. In some embodiments, the core member may have a yield strength of 30-70 ksi (207-483 MPa).

In some embodiments, a structural brace may have a core member including a first end, a second end, and a center portion. In some embodiments, the center portion includes a cutout pattern disposed along the length of the center portion, a housing surrounding at least the center portion of the core member, and a spacing material between the core member and the housing.

In some embodiments, the core member may have an elasticity greater than the housing. In some embodiments, the first end of the core member may be coupled to one or more fins, which may be used to couple the structural brace to other structural members. In some embodiments, the second end of the core member may be coupled to one or more fins. In some embodiments, the housing may include a metal support positioned external to the core member. In some embodiments, the metal support may be a duct. In some embodiments, the housing may include a rigid cementitious layer, which may be proximate to the metal support and may surround the core member. In some embodiments, the spacing material may include plastic. In some embodiments, the spacing material may further include an air gap.

In some embodiments, a method of manufacturing a structural brace may include one or more of the following: providing the core member, producing the cutout pattern in the center portion by a cutting method, providing the housing, applying a spacing material to the core member such that the spacing material is between the core member and the housing, and positioning the core member internal to the housing. In some embodiments, the cutting method may include waterjet cutting, laser cutting, or plasma cutting. In some embodiments, the cutting method may produce a cut having a width of between about 0.01 mm and about 1 cm.

It is to be understood that both the foregoing general description and the following detailed description are exemplary and explanatory and are not restrictive of the invention, as claimed. It should be understood that the various embodiments are not limited to the arrangements and instrumentality shown in the drawings. It should also be understood that the embodiments may be combined, or that other embodiments may be utilized and that structural changes, unless so claimed, may be made without departing from the scope of the various embodiments of the present invention. The following detailed description is, therefore, not to be taken in a limiting sense.

BRIEF DESCRIPTION OF THE DRAWINGS

Example embodiments will be described and explained with additional specificity and detail through the use of the accompanying drawings in which.

DESCRIPTION OF EMBODIMENTS

Figure 1:
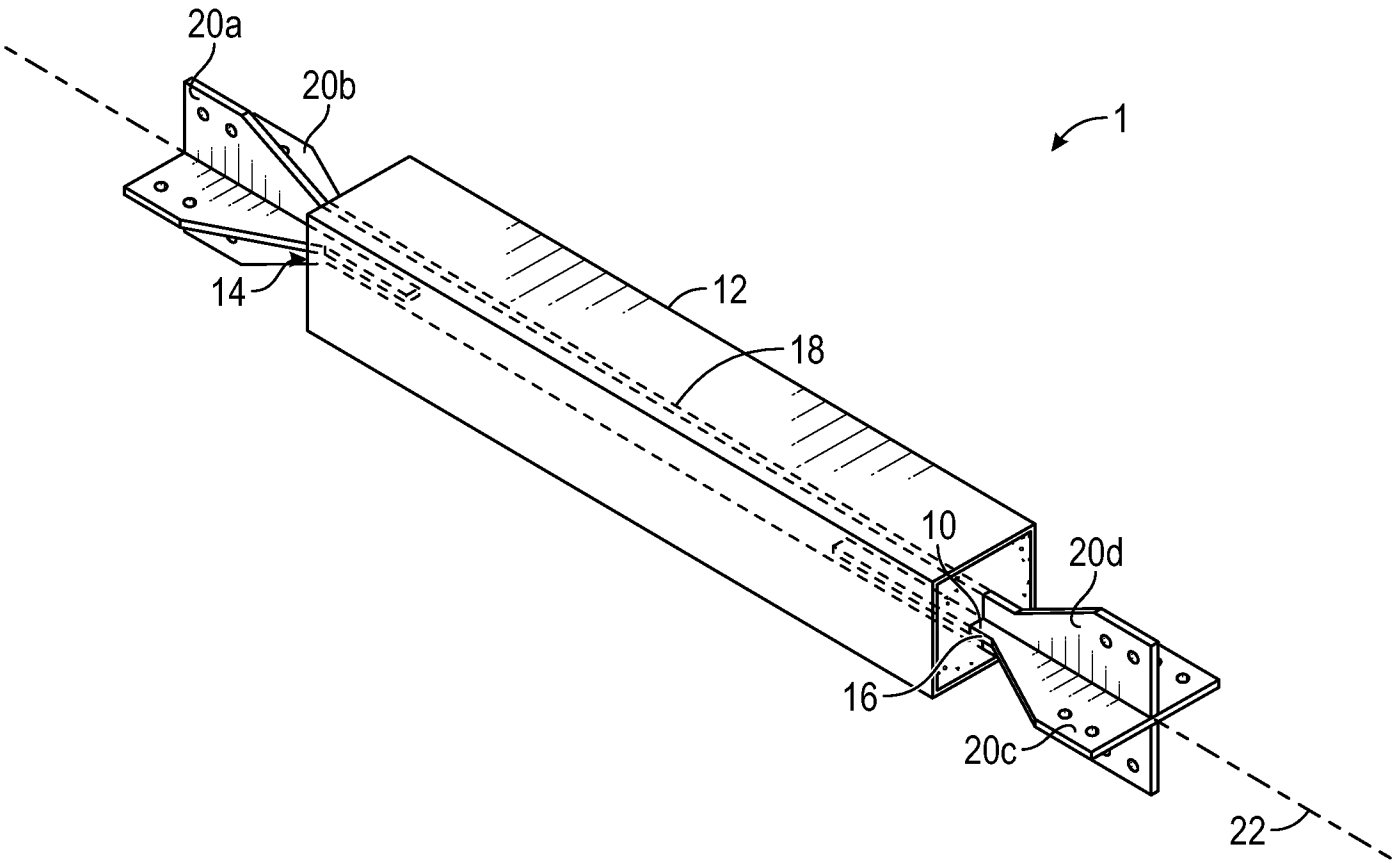
FIG. 1 is an upper perspective view of an example structural brace, according to some embodiments.

The present disclosure relates generally to a structural brace and related methods to manufacture structural braces. More particularly, in some embodiments, the present disclosure relates to a core member of a structural brace. Referring now to FIG. 1, in some embodiments, a structural brace 1 may include a core member 10 and a housing 12. In some embodiments, the core member 10 may include a first end 14, a second end 16, and a center portion 18 disposed between the first end 14 and the second end 16. In some embodiments, the first end 14 and/or the second end 16 may be coupled to one or more fins 20.

In some embodiments, the core member 10 may be configured to absorb energy, which may be generated by seismic, natural or other forces exerted on the structural brace 1. In some embodiments, energy may be absorbed by plastic deformation of the core member 10, but the core member 10 may be resistant to buckling, as will be explained in further detail. In some embodiments, the core member 10 may be constructed of metal, such as, for example, steel. In other embodiments, the core member 10 may be constructed of a non-steel material. In some embodiments, the core member 10 may be constructed of a composite material.

In some embodiments, the fins 20 may include a first fin 20*a*, a second fin 20*b*, a third fin 20*c*, and a fourth fin 20*d* (which may be referred to in the present disclosure as "fins 20"). In some embodiments, a number and position of the fins 20 may vary. In some embodiments, the fins 20 may be coupled to the core member 10 in any number of ways. In some embodiments, the fins 20 may be coupled to the core member 10 by a weld. In some embodiments, the fins 20 may be monolithically formed as a single unit with the core member 10 during manufacturing. In some embodiments, the fins 20 may be mechanically coupled to the core member 10 by bolts. In some embodiments, a variety of types and configurations of the fins 20 are possible without departing from the scope of the present disclosure. In some embodiments, the fins 20 may couple the structural brace 1 to one or more other structural members of a building including a steel frame, foundation, exterior structural walls, or interior columns.

In some embodiments, the fins 20 may couple to vertical columns of a particular structural member to brace the particular structural member against lateral forces and resist torsion. In some embodiments, the structural brace 1 may be installed horizontally on the structural member with respect to the ground. In some embodiments, the fins 20 may couple to a horizontal structural member of a particular structure to provide a load support for horizontal forces acting on structural members of a building. In some embodiments, the structural brace 1 may be installed vertically on the structural member with respect to the ground. In some embodiments, the structural brace 1 may be installed as a diagonal brace. In some embodiments, the structural brace 1 may act with a second structural brace to provide cross-bracing support. In some embodiments, the structural brace 1 may be installed with a second structural brace to provide V-bracing or chevron bracing to a particular structural member. In some embodiments, structural brace 1 may provide eccentric bracing, in which the fins 20 may couple the structural brace 1 to a particular structural member along a length of the structural member to provide resistance to lateral force.

In some embodiments, the housing 12 may be configured to surround and/or provide support to at least a center portion of core member 10. In some embodiments, the core member 10 may extend through the housing 12. In some embodiments, a variety of types and configurations of housing 12 are possible without departing from the scope of the present disclosure. In some embodiments, the housing may be rectangular or cylindrical.

In some embodiments, the center portion 18 may be configured to deform under high stress loads and the forces, which may include seismic, natural or other forces. In further detail, the center portion 18 may be configured to compress and/or elongate along a longitudinal axis 22 of the core member 10 in response to the forces. In some embodiments, the center portion 18 may be configured to deform as opposed to the first end 14 and/or the second end 16 bending or buckling away from the longitudinal axis 22 of the core member 10. In some embodiments, the center portion 18 may be configured to absorb the energy through deformation, and structural integrity of the first end 14, the second end 16, and the fins 20 may be maintained.

In some embodiments, deformation of the center portion 18 may be plastic. In some embodiments, in response to the forces exerted on the structural brace 1 being greater than an amount needed to deform the center portion 18 and less than an amount that would cause failure of the structural brace 1, the core member 10 may undergo plastic deformation without resulting in failure of the structural brace 1. In some embodiments, the housing 12 and/or the center portion 18 may also be configured to absorb the energy caused by the forces. In some embodiments, the first end 14 and/or the second end 16 may be resistant to bending due to the fins 20 and increased outer diameter of the fins 20.

Figure 2A:
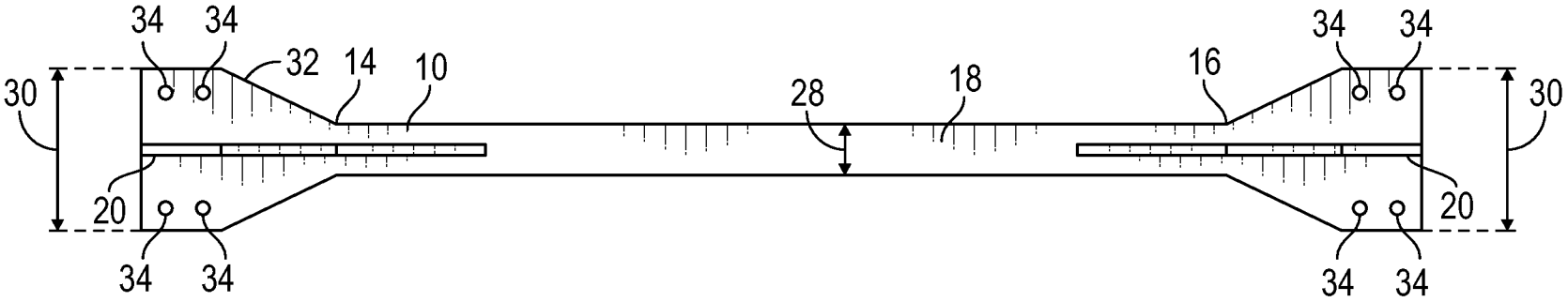
FIG. 2A is a side view illustrating an example core member of the structural brace of FIG. 1, according to some embodiments.
Figure 2B:
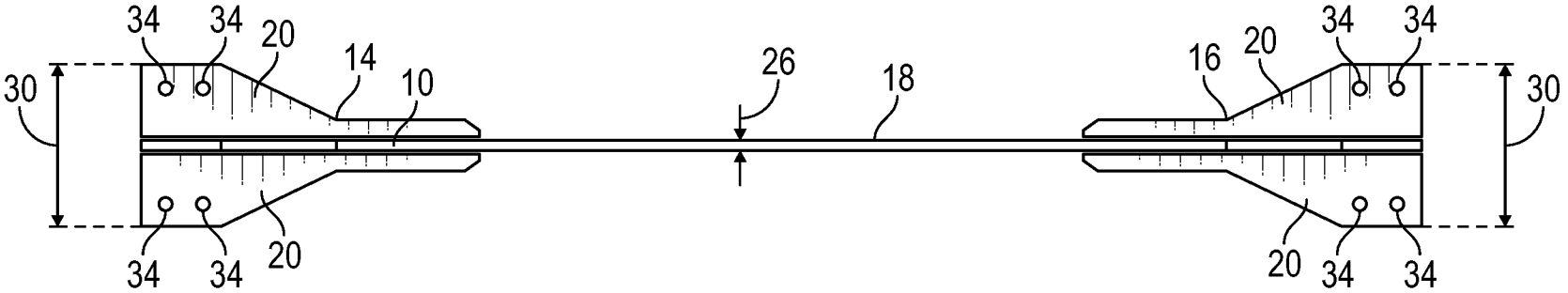
FIG. 2B is a top view illustrating the core member of the structural brace of FIG. 1, according to some embodiments.

Referring now to FIGS. 2A-2B, in some embodiments, the core member 10 may include the first end 14, the second end 16, and the center portion 18. In some embodiments, the core member 10 may be monolithically formed as a single unit. In some embodiments, a thickness 26 of the core member 10 (see, e.g., FIG. 2B) may be constant along all or a portion of one or more of the following: the first end 14, second end 16, and the center portion 18. In some embodiments, a width 28 of the core member 10 (see, e.g., FIG. 2A) may be constant along all or a portion of one or more of the following: the first end 14, second end 16, and the center portion 18.

In some embodiments, the width 28 at the first end 14 and/or the width 28 at the second end 16 may be equal to the width 28 at the center portion 18. In other embodiments, the width 28 at the first end 14 and/or the width 28 at the second end 16 may be greater than the width 28 at the center portion 18.

In some embodiments, an outer diameter 30 at two opposing fins 20 may be greater than the width 28 of the core member 10. In some embodiments, the fins 20 may include a taper region 32, which may taper out from the center portion 18. In some embodiments, the outer diameter 30 may be greater than the width 28 to provide rigidity to the first end 14 and/or the second end 16 in a lateral direction. In some embodiments, the fins 20 may provide support to the first end 14 and/or the second end 16, strengthening the first end 14 and/or the second end 16 such that the center portion 18 is more likely to deform than the first end 14 and/or the second end 16 in response to the forces being exerted on the structural brace 1.

In some embodiments, each of the fins 20 may include one or more holes 34. In some embodiments, the holes 34 may be configured to couple the structural brace 1 to other structural members. In some embodiments, a number of the holes 34 may vary. In some embodiments, each of the fins 20 may include two of the holes 34.

Figure 3:
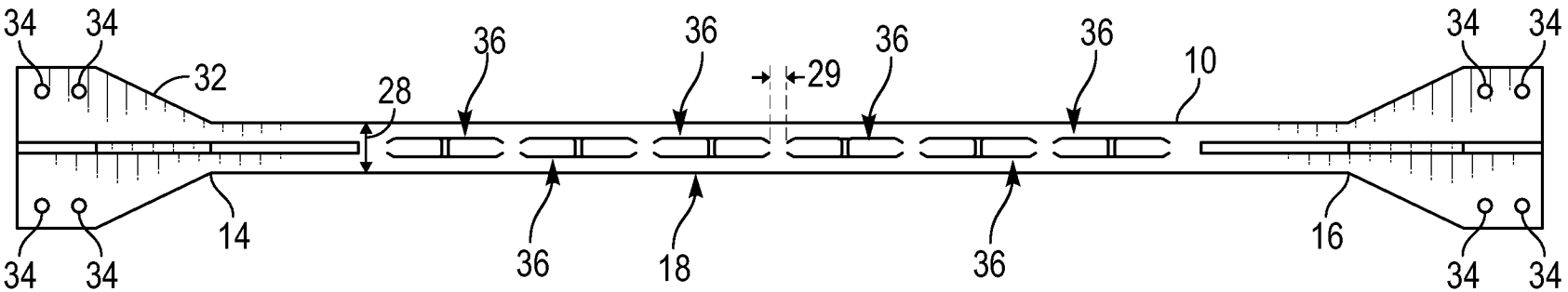
FIG. 3 is a side view of the core member of FIG. 1, illustrating a series of example cutout patterns, according to some embodiments.

Referring to FIG. 3, in some embodiments the center portion 18 may include a cutout pattern 36 disposed along the length of the center portion 18. In some embodiments, the cutout pattern 36 or a series of cutout patterns 36 may make the center portion 18 more susceptible to deformation at one or more particular locations. In some embodiments, deformation properties of the center portion 18 may vary with respect to the cutout pattern 36. In some embodiments, the cutout pattern 36 may designate one or more particular locations of center portion 18 where the structural brace 1 may deform. In other embodiments, the width of the center portion 18 may not be constant along the length of the center portion 18.

In some embodiments, the core member 10 may have a yield strength of about 30-40 ksi (207-276 MPa). In some embodiments, the core member 10 may have a yield strength of about 60-70 ksi (414-483 MPa). In some embodiments, the core member 10 may have a yield strength between about 30 ksi and about 70 ksi. In some embodiments, the core member 10 may have a yield strength of about 40-50 ksi. In some embodiments, the core member 10 may have a yield strength of about 50-60 ksi. In some embodiments, the yield strength of the core member 10 may vary.

Figure 4:
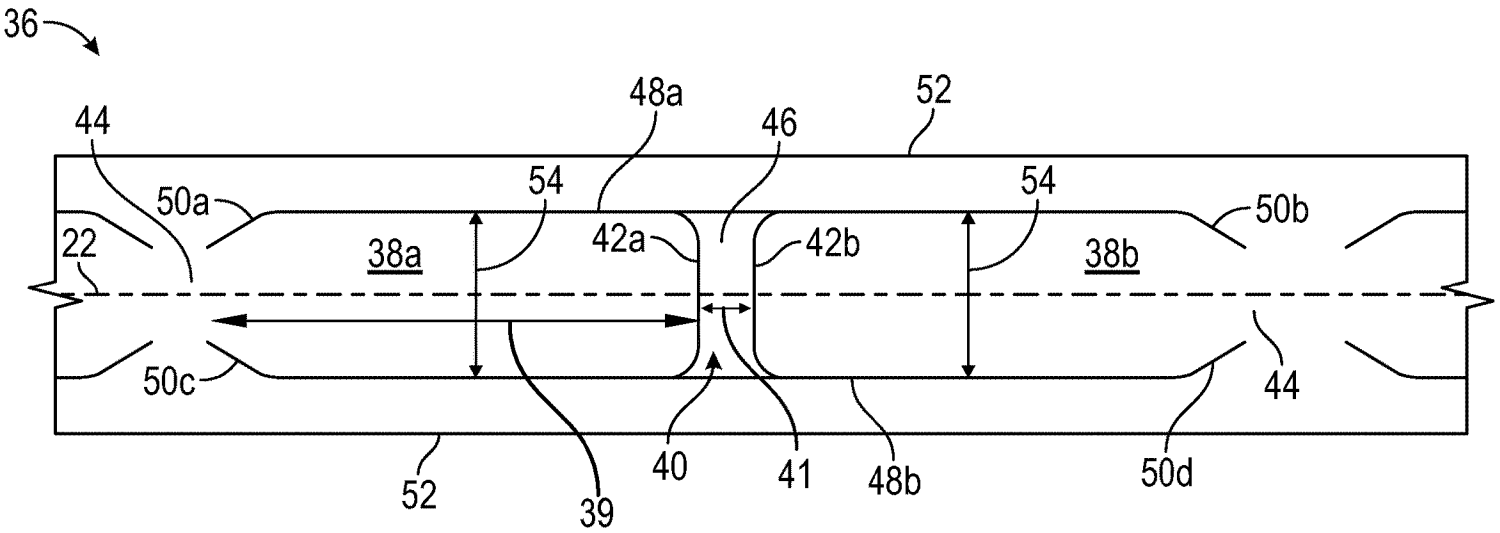
FIG. 4 is an enlarged view of a portion of the series of cutout patterns of FIG. 3, according to some embodiments.

Referring now to FIG. 4, a portion of a series that includes the cutout pattern 36 is illustrated, according to some embodiments. In some embodiments, the cutout pattern 36 may include a first paddle 38*a* and a second paddle 38*b* within a hole 40 extending through the center portion 18. In some embodiments, the hole 40 may include a generally oval shape. In some embodiments, the first paddle 38*a* and the second paddle 38*b* (which may be referred to in the present disclosure as "paddles 38") may be retained within the hole 40 to prevent the center portion 18 from buckling into the hole 40.

In some embodiments, in response to a force, the paddles 38 within the hole 40 may move toward each other and/or may contact each other, which may reduce the void 46 and a space within the hole 40 into which the center portion 18 might otherwise buckle. Thus, in some embodiments, the paddles 38 may act to brace the core member 10. In further detail, in some embodiments, the paddles 38 may prevent the center portion 18 of the core member 10 proximate the hole 40 from buckling in an inward direction or into the cutout pattern 36. In some embodiments, because the paddles 38 may include the same material as the center portion 18, the paddles 38 may be strong enough to resist buckling of the center portion 18 into the hole 40 as the paddles 38 approach each other or as they press upon each other.

In some embodiments, the first paddle 38*a* may include a distal end 42*a* and the second paddle 38*b* may include a distal end 42*b*, respectively. In some embodiments, the paddles 38 may be formed by a series of cuts through the core member 10. In some embodiments, the distal ends 42 of the paddles 38 may be rounded.

In some embodiments, the paddles 38 may be coupled to the center portion 18 at a coupling point 44, which may be disposed near a longitudinal vertex of the generally oval shape. In some embodiments, the paddles 38 may be monolithically formed as a single unit with the center portion 18. In some embodiments, a width of the coupling point 44 may vary based on, for example, a weight of the paddles 38, an analysis of seismic or stress forces on the center portion 18, and an arrangement of the cutout pattern 36 near the coupling point 44.

In some embodiments, the center portion 18 may include one or more cutout patterns 36, which may be similar or identical to each other. In some embodiments, the cutout patterns 36 may be spaced apart along the length of the center portion 18. In some embodiments, a particular cutout pattern 36 may be spaced apart from another particular cutout pattern 36 by a distance. In some embodiments, the distance 29 may be determined by a length of the paddles 38, because the distance 29 may provide support and facilitate alignment of the paddles 38 with the longitudinal axis 22 of the core member 10 during manufacturing.

In some embodiments, a series of cuts may form the cutout pattern 36. In some embodiments, the series of cuts may have a width tolerance, which may also affect buckling and/or material properties of the core member 10. In some embodiments, the width of one or more cuts of the series of cuts may be as narrow as about 1 millimeter. In some embodiments, the width of one or more cuts of the series of cuts may be about 1 centimeter.

In some embodiments, the cutout pattern 36 may include a void 46 between the paddles 38. In some embodiments, the void 46 may be formed by a hole 40. In some embodiments, the hole 40 may include a first elongated edge 48*a*, a second elongated edge 48*b*, and one or more angled edges 50*a*-50*d*. In some embodiments, the void 46 may be disposed between the distal ends 42*a,b* of the paddles 38*a,b* and between a first elongated edge 48*a* and a second elongated edge 48*b*.

In some embodiments, the first elongated edge 48*a* and/or the second elongated edge 48*b* may extend parallel to the longitudinal axis 22 of the core member 10. In some embodiments, the void 46 may provide enough space between the distal ends 42*a,b* of the paddles such that when the core member 10 is compressed, the paddles do not contact each other. In some embodiments, the paddles 38*a,b* may move toward each other as the core member 10 experiences the forces, decreasing or eliminating the void 46.

In some embodiments, the hole 40 may include a first angled edge 50*a* extending from a first end of the first elongated edge 48*a* and/or a second angled edge 50*b* extending from a first end of the second elongated edge 48*b*. In some embodiments, the first angled edge 50*a* and/or the second angled edge 50*b* may extend toward the longitudinal axis 22 of the core member 10.

In some embodiments, the hole 40 may include a third angled edge 50*c* extending from a first end of the second elongated edge 48*b* and/or a fourth angled edge 50*d* extending from a second end of the second elongated edge 48*b*. In some embodiments, the third angled edge 50*c* and/or the fourth angled edge 50*d* may extend toward the longitudinal axis 22 of the core member 10.

Figure 5:
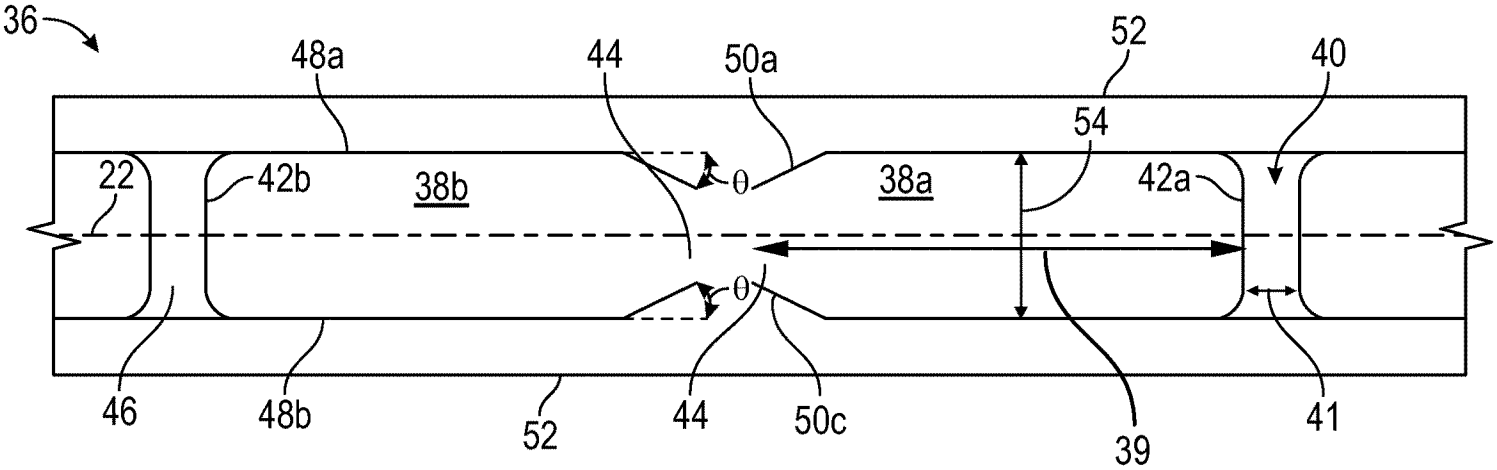
FIG. 5 is an enlarged view of another portion of the series of cutout patterns of FIG. 3, according to some embodiments.

Referring to FIG. 5, in some embodiments, the angled edges 50*a*-50*d* may form a semi-major axis of the generally oval shape. In some embodiments, the angled edges 50*a*-50*d* may be equal in length and angled toward a vertex of the generally oval shape. In some embodiments, the angled edges 50*a*-50*d* may end at the coupling point 44. In some embodiments, the angled edges 50*a*-50*d* may terminate to provide sufficient support to the proximal ends of the paddles 38. In some embodiments, the angled edges 50*a*-50*d* may be cut at an angle θ with respect to the elongated edges 48*b*. In some embodiments, the angle θ may be between about 30° and about 60° with respect to the first elongated edge 48*a* and/or the second elongated edge 48*b*.

In some embodiments, the second elongated edge 48*b* may extend parallel to the longitudinal axis 22 of the core member 10 and/or parallel to the first elongated edge 48*a*. In some embodiments, a length of the first elongated edge 48*a* may be equal to a length of the second elongated edge 48*b*. In some embodiments, the first elongated edge 48*a* and the second elongated edge 48*b* may be an equal distance from an opposing lateral side 52 of the core member 10. In some embodiments, the width 54 of the paddles 38 relative to the width 28 of the center portion 18 may determine a yield strength of the core member 10.

In some embodiments, each of the angled edges 50*a*-50*d* may have an equal length. In some embodiments, the first paddle 38*a* and the second paddle 38*b* may be disposed between the first elongated edge 48*a* and the second elongated edge 48*b*. In some embodiments, the paddles 38 may experience a lesser tension and/or compression forces than applied to core member 10 because the angled edges 50*a*-50*d* may direct the energy to the opposing lateral side 52 of the core member 10.

In some embodiments, the paddles 38 may be coupled to the elongated body at the coupling point 44. In some embodiments, the end of the first paddle 52*a* and/or the end of the second paddle 52*b* may be perpendicular to the first elongated edge 48*a* and/or the second elongated edge 48*b*. In some embodiments, the end of the first paddle 52*a* and the end of the second paddle 52*b* may be disposed between the first elongated edge 48*a* and the second elongated edge 48*b*.

Figure 6:
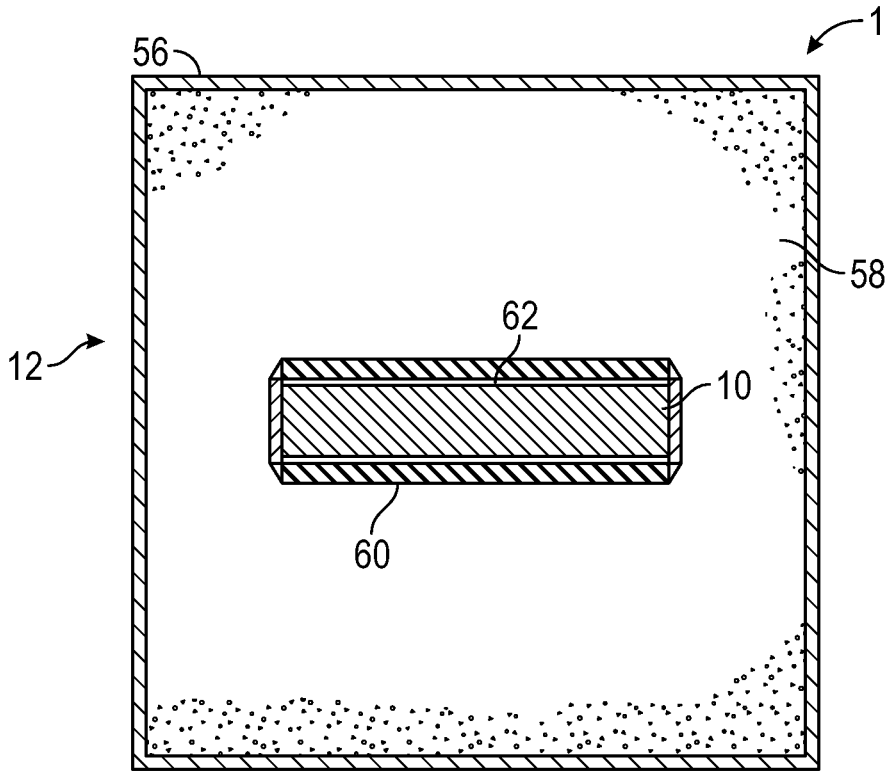
FIG. 6 is a cross-sectional view of the structural brace of FIG. 1, through the core member between two adjacent cutout patterns, according to some embodiments.

Referring now to FIG. 6, in some embodiments, the housing 12 may be configured to surround the core member 10 to prevent the structural brace 1 from buckling when the core member 10 undergoes plastic deformation. In some embodiments, the housing 12 may include a metal support 56, a cement or cementious layer 58, and a spacing material 60. In some embodiments, the metal support 56 may include a rectangular or square duct external to the cementious layer 58. In some embodiments, the metal support 56 may include various shapes, such as, for example, cylindrical. In some embodiments, the metal support 56 may be constructed of steel or another suitable material.

In some embodiments, the metal support 56 may provide strength, flexibility, and a mechanism for enclosing the cementious layer 58, the spacing material 60, and the core member 10. In some embodiments, the cementious layer 58 may be located internal to the metal support 56. In some embodiments, the cementious layer 58 may provide rigidity to the housing 12. In some embodiments, the cementious layer 58 may be rigid. In some embodiments, the cementious layer 58 may have less elasticity than the core member 10.

In some embodiments, the cementious layer 58 may contact the metal support 56 and/or the cementious layer 58 may surround the core member 10. In some embodiments, the metal support 56 may not surround the cementious layer 58 and may be internal to the cementious layer 58.

In some embodiments, a spacing material 60 may be positioned internal to cementious layer 58. In some embodiments, the spacing material 60 may be configured to limit friction caused by the movement of part or all of core member 10 relative to the housing 12. In some embodiments, the spacing material 60 may be a plastic or another suitable material. In some embodiments, the spacing material 60 may include a high density polyethylene (HDPE). In some embodiments, the spacing material 60 may include an ultra-high molecular weight (UHMW) polyethylene. In some embodiments, the spacing material 60 may include TEFLON™. In some embodiments, the spacing material 60 may include a material having low compressibility. In some embodiments, the spacing material 60 may circumscribe the core member 10.

In some embodiments, the spacing material 60 may be spaced apart from the core member 10 by an air gap 62. In some embodiments, the air gap 62 may be positioned between the core member 10 and the housing 12. In some embodiments, the spacing material 60 may be positioned adjacent and contact the core member 10. In some embodiments, the air gap 62 may be positioned between the spacing material 60 and the core member 10. In some embodiments, the air gap 62 may be positioned between the spacing material 60 and the housing 12. In some embodiments, the air gap 62 may reduce contact between the core member 10 and the spacing material 60 when there is little or no load on the structural brace 1. In some embodiments, the air gap 62 may also be designed such that when the core member 10 is compressed and deformation of the core member 10 occurs, the core member 10 contacts the spacing material 60.

In some embodiments, the air gap 62 may be configured to prevent bonding of the core member 10 to the housing 12. In some embodiments, by preventing bonding of the core member 10 to the housing 12, the core member 10 may move freely with respect to housing 12 when the core member 10 undergoes deformation. For example, where the structural brace 1 is configured to absorb the forces, the compression and tension exerted on structural brace 1 may compress and elongate the core member 10. In some embodiments, the air gap 62 may be configured to provide a space between the core member 10 and the spacing material 60 when the structural brace 1 is not supporting a load. In some embodiments, in response to the core member 10 not being bonded to the housing 12, when forces are exerted on structural brace 1, the forces may be primarily absorbed by core member 10.

In some embodiments, the spacing material 60 may facilitate little or no friction being generated between housing 12 and core member 10 when the forces are exerted on structural brace 1 and core member 10, which may be extended and compressed. In some embodiments, when the forces exceed a threshold, the forces may be absorbed by plastic deformation of the core member 10. In some embodiments, plastic deformation of the core member 10 may result in an expansion or thickening of the core member 10, which may cause the core member 10 to contact the housing 12. In some embodiments, the spacing material 60 may limit friction caused by compression and/or elongation of the core member 10. Additionally, in some embodiments, the spacing material 60 may facilitate the structural brace 1 to undergo many cycles of compression and tension without significantly deteriorating the core member 10.

Figure 7:
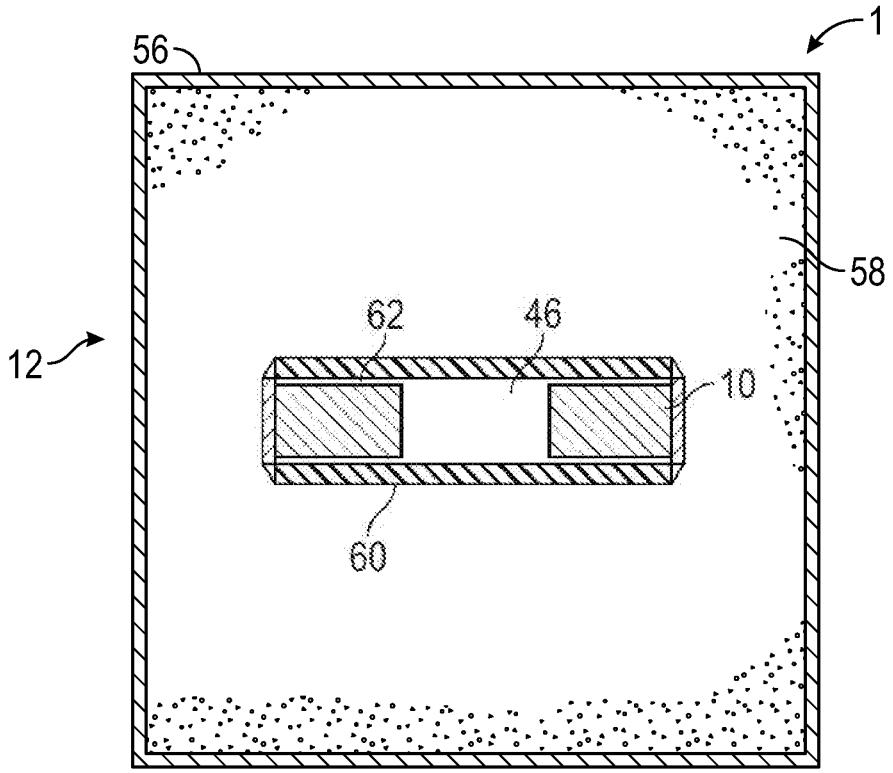
FIG. 7 is another cross-sectional view of the structural brace of FIG. 1, through an example void, according to some embodiments.

Referring now to FIG. 7, a cross-section of the core member 10 at a portion of the core member that includes the void 46 is illustrated, according to some embodiments. In some embodiments, when the forces are exerted on the structural brace 1 and the core member 10 undergoes deformation, the portions of the center portion 18 proximate the void 46 may undergo a more significant deformation than portions of the center portion 18 that are not proximate the void 46.

Figure 8:
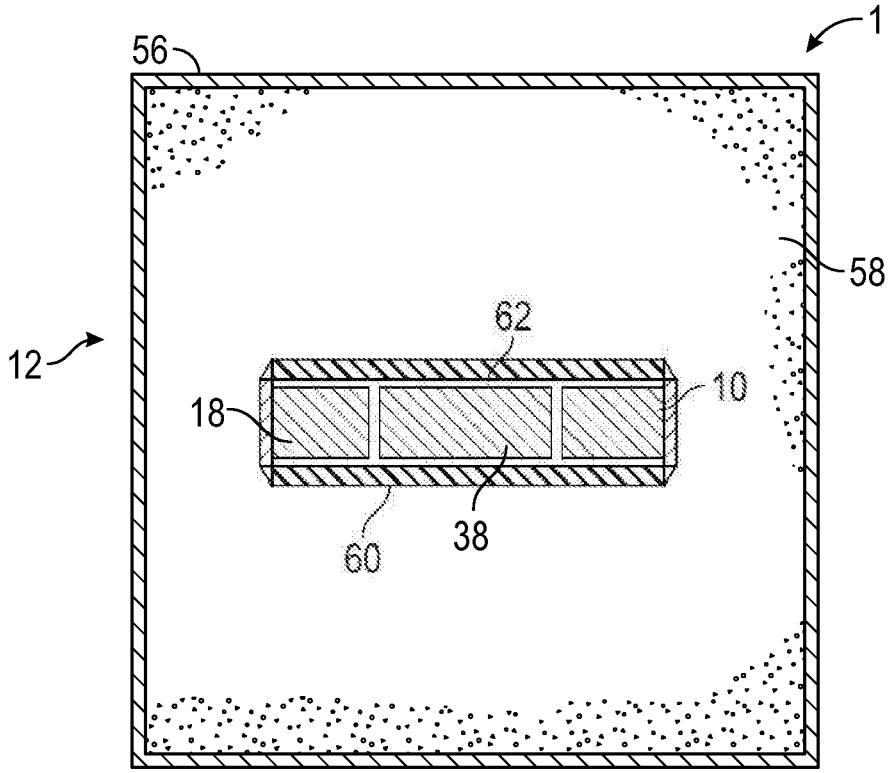
FIG. 8 is another cross-sectional view of the structural brace of FIG. 1, through an example paddle, according to some embodiments.

Referring now to FIG. 8, a cross-section of the core member 10 at the center portion 18 that includes an example paddle 38 is illustrated, according to some embodiments. In some embodiments, when the forces are exerted on the structural brace 1 and the core member 10 undergoes deformation, even though the portions of the center portion 18 proximate the hole 40 may undergo a more significant deformation than the paddle 38, the portions of the center portion 18 proximate the hole 40 may be obstructed from buckling into the hole 40 by the paddles 38. Thus, in some embodiments, the paddles 38 brace the core member 10 and prevent the center portion 18 from buckling laterally into the hole 40.

Figure 9A:
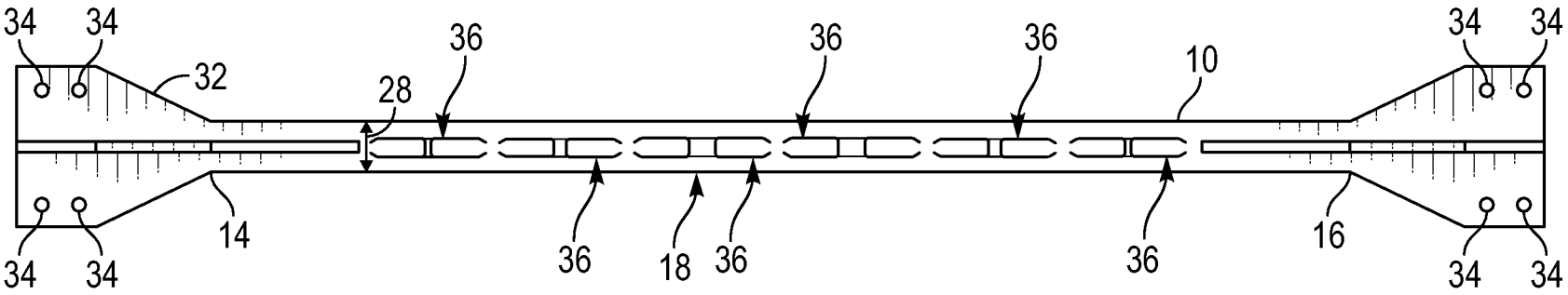
FIG. 9A is a side view of another core member that may be used with the structural brace of FIG. 1, illustrating another series of example cutout patterns, according to some embodiments.
Figure 9B:
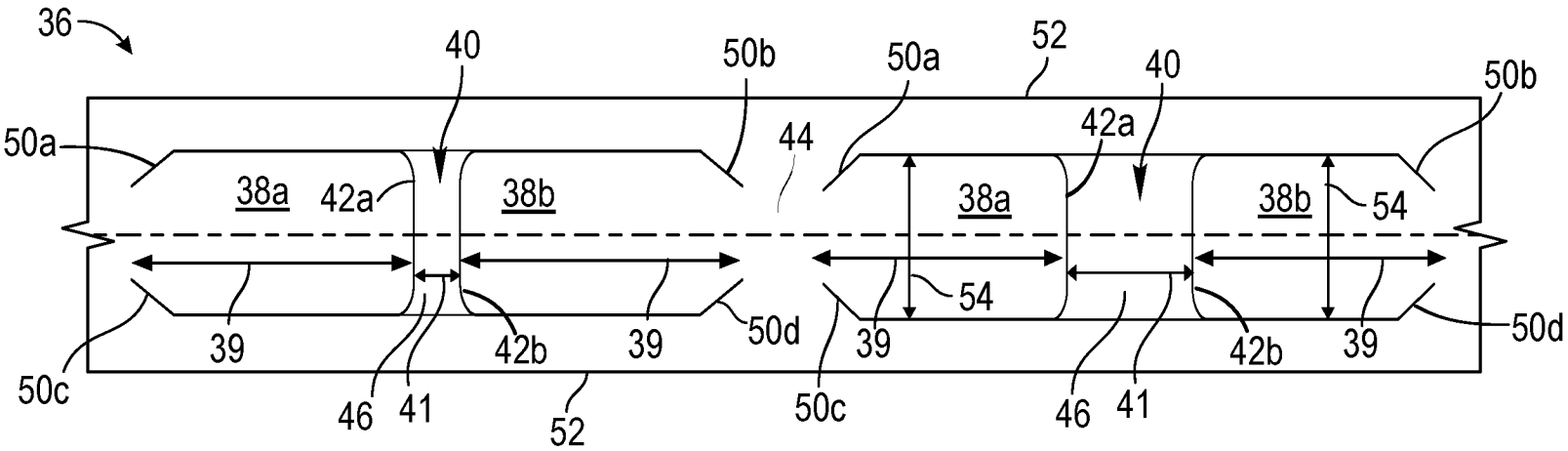
FIG. 9B is an enlarged view of a portion of the series of cutout patterns of FIG. 9A, according to some embodiments.

Referring now to FIGS. 9A and 9B, in some embodiments, the center portion 18 may include multiple cutout patterns 36 spaced apart along the center portion 18. In some embodiments, the first elongated edge 48*a* and/or the second elongated edge 48*b* of a particular cutout pattern 36 proximate or towards the first end 14 may be shorter than the first elongated edge 48*a* and/or the second elongated edge 48 of another particular cutout pattern 36 closer to a center of the core member 10 than the particular cutout pattern 36. In some embodiments, a particular cutout pattern 36 proximate or towards the second end 16 may be shorter than the first elongated edge 48*a* and/or the second elongated edge 48 of another particular cutout pattern 36 closer to the center of the core member 10 than the particular cutout pattern 36.

In some embodiments, a longitudinal length 39 of the paddles 38*a,b* may vary between the cutout patterns 36. In some embodiments, the longitudinal length 39 of the paddles 38*a,b* of the particular cutout pattern 36 disposed proximate or towards the first end 14 may be less than the longitudinal length 39 of the paddles 38*a,b* of another particular cutout pattern 36 closer to a center of the core member 10 than the particular cutout pattern 36. In some embodiments, the longitudinal length 39 of the paddles 38*a,b* of a particular cutout pattern 36 disposed proximate or towards the second end 16 may be less than the length 39 of the paddles 38*a,b* of another particular cutout pattern 36 closer to the center of the core member 10 than the particular cutout pattern 36.

In some embodiments, the void 46 may include a longitudinal length 41 between the distal ends 42*a,b* of the paddles 38*a,b* that may vary between cutout patterns 36. In some embodiments, the length 41 between the distal ends 42*a,b* of the paddles 38*a,b* of the particular cutout pattern 36 disposed proximate or towards the first end 14 may be less than the length 41 between the distal ends 42*a,b* of the paddles 38*a,b* of the other particular cutout pattern 36 closer to a center of the core member 10 than the particular cutout pattern. In some embodiments, the length 41 between the distal ends 42*a,b* of the paddles 38*a,b* of the particular cutout pattern 36 disposed proximate or towards the second end 16 may be less than the length 41 between the distal ends 42*a,b* of the paddles 38*a,b* of the other particular cutout pattern 36 closer to a center of the core member 10 than the particular cutout pattern.

As explained with respect to FIG. 4, in some embodiments, in response to a force, the paddles 38 within the hole 40 move toward each other and/or may contact each other, which may reduce the void 46 and a space within the hole 40 into which the center portion 18 might otherwise buckle. Thus, in some embodiments, the paddles 38 may act to brace the core member 10. In further detail, in some embodiments, the paddles 38 may prevent the center portion 18 of the core member 10 proximate the hole 40 from buckling in an inward direction or into the cutout pattern 36. In some embodiments, because the paddles 38 may include the same material as the center portion 18, the paddles 38 may be strong enough to resist buckling of the center portion 18 into the hole 40 as the paddles 38 approach each other or as they press upon each other and occupy the void 46.

A method of manufacturing the structural brace 1 may include providing the core member 10, which may include the first end 14, the second end 16, and the center portion 18. In some embodiments, the core member 10 may further include a cutout pattern 36 in the center portion 18. In some embodiments, the cutout pattern 36 may include the hole 40, which may extend through the center portion 18. In some embodiments, the hole 40 may include a generally oval shape.

In some embodiments, the cutout pattern 36 may be produced by cutting the core member 10 with a cutting method. In some embodiments, the cutting method may include waterjet cutting, laser cutting, or plasma cutting. In some embodiments, the cutting method may produce cuts as narrow as about 1 mm. In other embodiments, the cutting method may produce cuts as wide as about 1 cm. In some embodiments, the cuts may be between about 1 mm and about 1 cm.

In some embodiments, one or more spacers may be added to a particular void 46 of the cutout pattern 36 of the core member 10. In some embodiments, the spacers may be used to create the air gap 62 between the core member 10 and the spacing material 60. In some embodiments, the spacers may prevent a cementious material from the cementious layer 58 from entering the air gap 62 and/or the void 46. In some embodiments, the spacers may prevent hydrostatic pressure of the cementious material from over pressurizing the spacing material 60 and filling the void 46. In some embodiments, the spacers may include tape, silicone, foam, foam rubber, fiberglass, plastic, insulated materials, or any other suitable materials.

In some embodiments, the spacing material 60 may be applied to the core member 10 following the cutting of the core member with the cutting method and the application of spacers to the core member where required. In some embodiments, the spacing material 60 may be positioned adjacent to the center portion 18. In some embodiments, the spacers may be interposed between the spacing material 60 and the core member 10. In some embodiments, after the spacing material 60 is applied to the core member 10, the core member 10 may then be inserted through and positioned within the metal support 56 such that the first end 14 and second end 16 extend out of the opposing ends of the metal support 56. In some embodiments, the cementious material may then be introduced into the space between the spacing material 60 and the metal support 56. In some embodiments, the cementious material may be poured into the metal support 56 in a liquid or semi-liquid state and then solidified to become the cementious layer 58.

All examples and conditional language recited herein are intended to aid the reader in understanding the disclosure and the concepts to furthering the art, and are intended to be construed as being without limitation to such specifically recited examples and conditions. Although embodiments of the present inventions have been described in detail, it should be understood that the various changes, substitutions, and alterations could be made hereto without departing from the spirit and scope of the disclosure.

The invention claimed is:

1. A structural brace, comprising:

a core member comprising a center portion having a cutout pattern disposed along the center portion, the cutout pattern comprising a hole through the center portion and a first paddle and a second paddle disposed within the hole, wherein the core member provides plastic deformation and resists buckling in response to absorption of energy.

2. The structural brace of claim 1, wherein the core member is monolithically formed as a single unit and has a constant width.

3. The structural brace of claim 1, wherein the hole has a generally oval shape.

4. The structural brace of claim 3, wherein the first paddle and the second paddle extend from an edge of the hole.

5. The structural brace of claim 4, wherein the first paddle and the second paddle are coupled to the core member at a longitudinal vertex of the generally oval shape.

6. The structural brace of claim 5, wherein the first paddle and the second paddle are spaced apart by a void between the first paddle and the second paddle, wherein the void is configured to permit the first paddle and the second paddle to move toward each other as the core member is longitudinally compressed.

7. The structural brace of claim 1, wherein the center portion comprises a plurality of cutout patterns spaced apart along a length of the center portion, each of the plurality of cutout patterns comprising a hole through the center portion and a first paddle and a second paddle disposed within the hole.

8. The structural brace of claim 1, wherein the hole comprises:

a first elongated edge extending parallel to a longitudinal axis of the core member;

a second elongated edge extending parallel to the longitudinal axis of the core member and parallel to the first elongated edge;

a first angled edge extending from a first end of the first elongated edge;

a second angled edge extending from a second end of the first elongated edge, wherein a length of the first angled edge is equal to a length of the second angled edge;

a third angled edge extending from a first end of the second elongated edge; and a fourth angled edge extending from a second end of the second elongated edge, wherein the first paddle and the second paddle are disposed between the first elongated edge and the second elongated edge, wherein an end of the first paddle and an end of the second paddle are spaced apart by a void between the end of the first paddle and the end of the second paddle, wherein the end of the first paddle and the end of the second paddle are perpendicular to the first elongated edge and the second elongated edge.

9. The structural brace of claim 8, wherein the first angled edge and the second angled edge are angled between 30° and 60° with respect to the first elongated edge.

10. The structural brace of claim 1, wherein the core member further comprises a yield strength of 30-70 ksi.

11. A structural brace, comprising:

a core member comprising a first end, a second end, and a center portion, wherein the center portion comprises a cutout pattern, the cutout pattern comprising a hole through the center portion and a first paddle and a second paddle disposed within the hole;

a housing surrounding at least the center portion of the core member; and a spacing material between the core member and the housing.

12. The structural brace of claim 11, wherein the core member is monolithically formed as a single unit and has a constant width.

13. The structural brace of claim 11, wherein the core member has an elasticity greater than the housing.

14. The structural brace of claim 11, further comprising a first fin and a second fin, wherein the first fin is coupled to the first end of the core member and the second fin is coupled to the second end of the core member, wherein the first fin and the second fin are configured to couple the structural brace to other structural members.

15. The core member of claim 11, wherein the hole has a generally oval shape.

16. The core member of claim 15, wherein the first paddle and the second paddle extend from an edge of the hole.

17. The structural brace of claim 11, wherein the center portion comprises a plurality of cutout patterns spaced apart along a length of the center portion, each of the plurality of cutout patterns comprising a hole and a first paddle and a second paddle disposed within the hole.

18. The structural brace of claim 11, wherein the housing comprises:

a metal support positioned external to the core member, wherein the metal support comprises a duct; and a rigid cementitious layer proximate the metal support and surrounding the core member.

19. The structural brace of claim 11, wherein the spacing material comprises a plastic.

20. The structural brace of claim 19, wherein the spacing material further comprises an air gap.

21. A method of manufacturing a structural brace, comprising:

providing a core member comprising a first end, a second end, and a center portion;

providing a cutout pattern in the center portion by a cutting method, the cutout pattern comprising a first paddle and a second paddle;

providing a housing comprising a metal support and a rigid cementitious layer, wherein the metal support comprises a metal duct;

applying a spacing material to the core member such that the spacing material is between the core member and the housing;

positioning the core member internal to the housing.

22. The method of claim 21, wherein the cutout pattern comprises a hole extending through the center portion, wherein the hole has a generally oval shape.

23. The method of claim 21, wherein the cutting method comprises watejet cutting, laser cutting, or plasma cutting.

24. The method of claim 21, wherein the cutting method produces a cut having a width of between 0.01 mm and 1 cm.

* * * * *